US007621624B2

(12) United States Patent
Pan et al.

(10) Patent No.: US 7,621,624 B2
(45) Date of Patent: Nov. 24, 2009

(54) HIGH-EFFICIENT ULTRASONIC INK-JET HEAD AND FABRICATION METHOD OF FOR THE SAME

(75) Inventors: Min-Chun Pan, Jhongli (TW); Lung-Ch Chang, Jhongli (TW); Jung-En Hsiao, Jhongli (TW)

(73) Assignee: National Central University, Jhongli, Taoyuan County (TW)

( * ) Notice: Subject to any disclaimer, the term of this patent is extended or adjusted under 35 U.S.C. 154(b) by 446 days.

(21) Appl. No.: 11/750,814

(22) Filed: May 18, 2007

(65) Prior Publication Data

US 2008/0284820 A1 Nov. 20, 2008

(51) Int. Cl.
*B41J 2/045* (2006.01)
*B41J 2/135* (2006.01)

(52) U.S. Cl. ..... 347/68; 347/46

(58) Field of Classification Search ..... 347/68, 347/69–72, 46; 400/124.14–124.17, 124.23; 310/323.06, 323.08, 324, 330, 331; 29/25.35
See application file for complete search history.

(56) References Cited

U.S. PATENT DOCUMENTS 4,751,529 A 6/1988 Elrod et al.
4,751,534 A 6/1988 Elrod et al.
5,041,849 A 8/1991 Quate et al.
6,045,208 A 4/2000 Hirahara et al.
6,154,236 A 11/2000 Roy et al.
6,364,454 B1 * 4/2002 Hadimioglu ..... 347/46
6,467,877 B2 * 10/2002 Ellson ..... 347/46

FOREIGN PATENT DOCUMENTS

EP 0 683 405 A1 11/1995

* cited by examiner

*Primary Examiner*—K. Feggins
(74) *Attorney, Agent, or Firm*—Chun-Ming Shih

(57) ABSTRACT

A highly-efficient ultrasonic wave ink-jet head includes a piezoelectric transducer and a Fresnel lens provided on a supporting layer. A chamber structure is fabricated on the supporting layer by lithography etching, and further bonded with an ink-storing groove to form an ink-jet head. The design provides a total reflection of ultrasonic waves generated on the opposite side of the piezoelectric transducer through the deviation of acoustic impedance of ultrasonic waves at different media. The sound energy of the ultrasonic wave can be effectively reused. Moreover, the phase of the reflected ultrasonic wave is consistent with that of the direct ultrasonic wave generated by the piezoelectric transducer. This forms a highly-efficient ultrasonic wave ink-jet head.

10 Claims, 5 Drawing Sheets

HIGH-EFFICIENT ULTRASONIC INK-JET HEAD AND FABRICATION METHOD OF FOR THE SAME

FIELD OF THE INVENTION

The present invention relates to a highly-efficient ultrasonic ink-jet head and a fabrication method for the same, and more particularly to a special design that utilizes a reflection chamber to effectively enhance the use of ultrasonic energy, overcomes the shortcomings of a conventional ultrasonic focusing ink-jet head having a multiple of dielectric layers, and reduces the loss of power consumption of ultrasonic energy, so as to improve the efficiency of ultrasonic applications, and such design can be applied in the areas related to a color filter manufacturing processes and graphic/text printers.

BACKGROUND OF THE INVENTION

In the method of driving and ejecting ink by sound waves as disclosed in U.S. Pat. No. 4,751,529, ultrasonic waves produced by a piezoelectric transducer are transmitted from an ultrasonic wave buffer rod at a glass medium, and refracted from a spherical concave lens, and focused at the ink surface for ejecting individual droplets of ink. Another method as disclosed in U.S. Pat. No. 4,751,534 fills up the depression of the original concave lens by another medium while maintaining the refraction and focus functions as well as a smooth flow of the ink transport. In 1991, U.S. Pat. No. 5,041,849 disclosed a manufacturing technology that substitutes the aforementioned original concave lens by a multi-level Fresnel lens to simplify the manufacturing process, while maintaining the focusing function. In 2000, U.S. Pat. No. 6,045,208 disclosed a two-layer fraction and focus method, and a second ink layer can be focused at the ink surface more quickly, and an elongated stripe-pattern focusing lens is produced by using the cross-section of the Fresnel lens as the cross-section of stripe pattern ink, so that the focal points are connected with each other into a line, and ink droplets are in the form of a stripe pattern. U.S. Pat. No. 6,154,236 and European Patent Publication No. 0,683,405 disclosed an ink-jet head with a double-layer flow, and an upper layer of the ink-jet head provides for an ink flow, so that ultrasonic waves are focused at the surface of a nozzle disposed at the top of the upper layer, and the flow at a lower layer of the ink-jet head provides for dissipating heat, so that the heat produced by a piezoelectric transducer is carried away by the fluid. These technologies can be applied in a color filter coating process.

In view of the description above, the aforementioned patents utilize sound waves or ultrasonic waves and the Fresnel lens for the focusing, but the methods of driving and ejecting droplets of ink by focusing sound waves as disclosed by Elrod and Handimioglu have not been applied in color filter coating technology. European Patent Publication No. 0,683,405 simply applies a method of using the Fresnel lens to focus and eject ink in a color filter coating process, but such patented invention still emphasizes on the two-layer refraction and focus method or a printer device (as disclosed in U.S. Pat. No. 6,045,208) only. The ultrasonic ink-jet head as disclosed in the foregoing patents utilize the ultrasonic wave on only one side of the piezoelectric transducer, and the ultrasonic wave on the opposite side of the piezoelectric transducer penetrates through a backing layer and discharges into the air. Therefore, the highly efficient ink-jet head in accordance with the present invention features a higher efficiency of using sound energy than the aforementioned conventional ultrasonic ink-jet heads.

In view of the aforementioned shortcomings and deficiencies of the prior art, the inventors of the present invention based on years of experience in the related industry to conduct extensive researches and experiments and finally developed a highly-efficient ultrasonic ink-jet head and a fabrication method for the same in accordance with the present invention to overcome the shortcomings and deficiencies of the prior art.

SUMMARY OF THE INVENTION

The present invention is to provide a novel design for improving the efficiency of using energy by an ultrasonic ink-jet head.

The present invention provides a highly-efficient ultrasonic ink-jet head and a fabrication method for the same, wherein an upper electrode is sputtered upon a piezoelectric transducer, on which a multi-level Fresnel lens is etched. Furthermore, a glass/silicon substrate is used as a supporting layer disposed under the piezoelectric transducer. Thus the ultrasonic wave produced by piezoelectric transducer can directly transmit into the ink without passing through the substrate so that it can reduce the power consumption of transmitting ultrasonic waves. A designated backing layer is formed on the glass/silicon supporting layer such that this structural design drives the backing layer to totally reflect the ultrasonic waves, which overlap with the ultrasonic wave on the opposite side and cause a constructive interference. This novel design maximizes the utility of planar acoustic energy generated by the piezoelectric transducer to drive and eject ink droplets by focused energy.

DETAILED DESCRIPTION OF THE PREFERRED EMBODIMENTS

To make it easier for our examiner to understand the objective of the invention, its structure, innovative features, and performance, we use a preferred embodiment together with the attached drawings for the detailed description of the invention.

Figure 1:
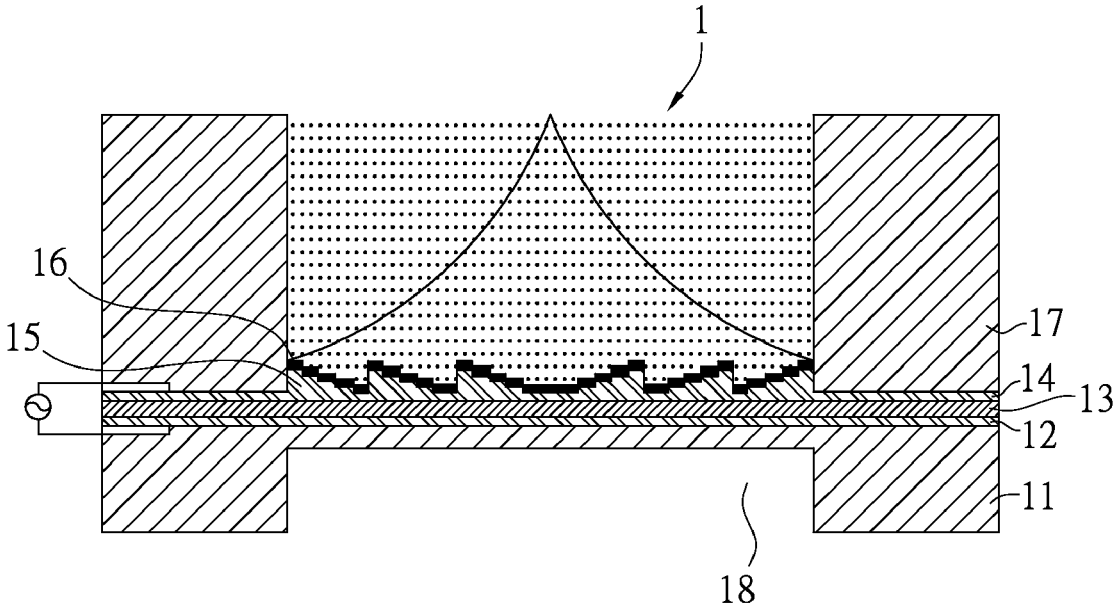
FIG. 1 is a section view of a highly-efficient ultrasonic ink-jet head structure in accordance with the present invention.

Referring to FIG. 1 for a schematic view of a highly-efficient ultrasonic ink-jet head structure in accordance with the present invention, a glass/silicon substrate 11 is used as a supporting layer, and the supporting layer is designed, etched and manufactured, such that the ultrasonic wave can be reflected, and the sound pressure of the ultrasonic wave on another side is of the same phase, and a piezoelectric transducer is fabricated on the supporting layer. The piezoelectric transducer comprises a lower electrode layer 12 made of a metal film, a piezoelectric layer 13 and an upper electrode layer 14 made of a metal film. The upper electrode layer 14 is fabricated like a plane lens, which is a four-level Fresnel lens 15 in this embodiment, and the plane lens 15 has the structure of a $2^n$-level Fresnel lens, where n is a positive integer, and then an acoustic impedance matching layer 16 is coated, and bonded with an ink storing groove 17 to constitute a highly-efficient ultrasonic ink-jet head 1.

Figure 2A:
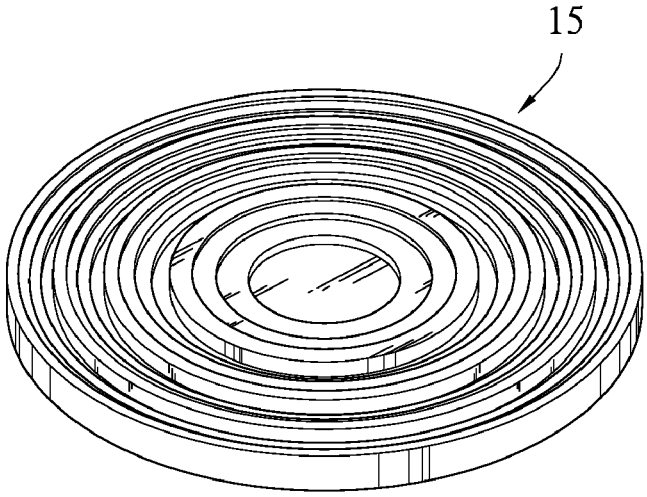
FIG. 2A is a perspective view of a four-level Fresnel lens of a highly-efficient ultrasonic ink-jet head in accordance with the present invention.
Figure 2B:
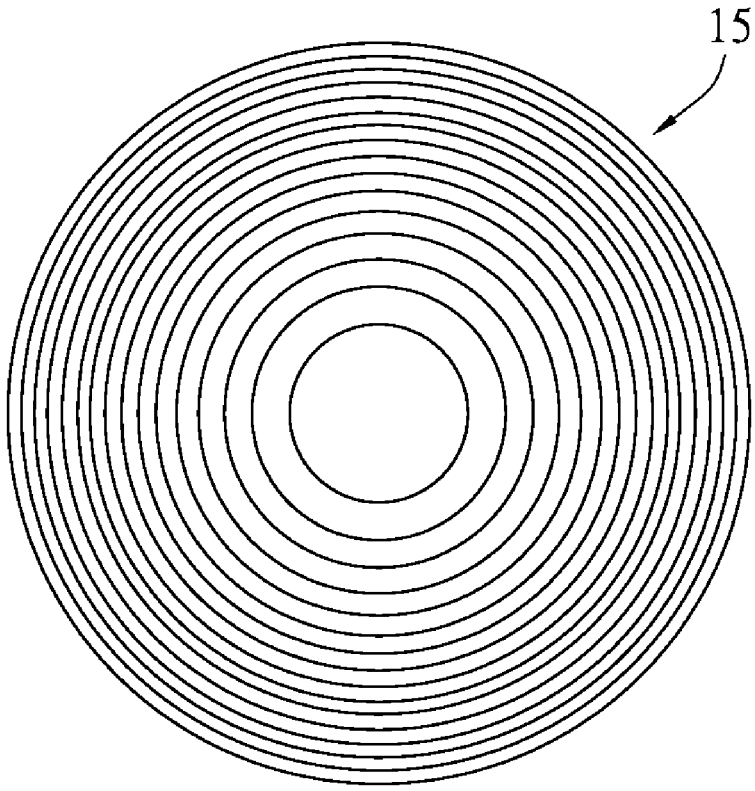
FIG. 2B is a top view of a four-level Fresnel lens of a highly-efficient ultrasonic ink-jet head in accordance with the present invention.
Figure 2C:
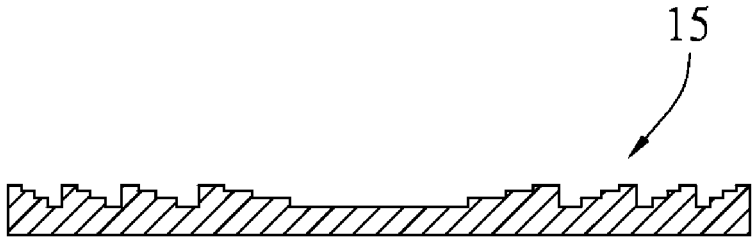
FIG. 2C is a side view of a four-level Fresnel lens of a highly-efficient ultrasonic ink-jet head in accordance with the present invention.

Referring to FIGS. 2A, 2B and 2C for a perspective view, a top view and a side view of a four-level Fresnel lens of a highly-efficient ultrasonic ink-jet head in accordance with the present invention, respectively, the four-level Fresnel lens 15 can be fabricated easily as compared with spherical lens and etched easily on an upper electrode layer 14 as shown in FIG. 1.

Figure 3:
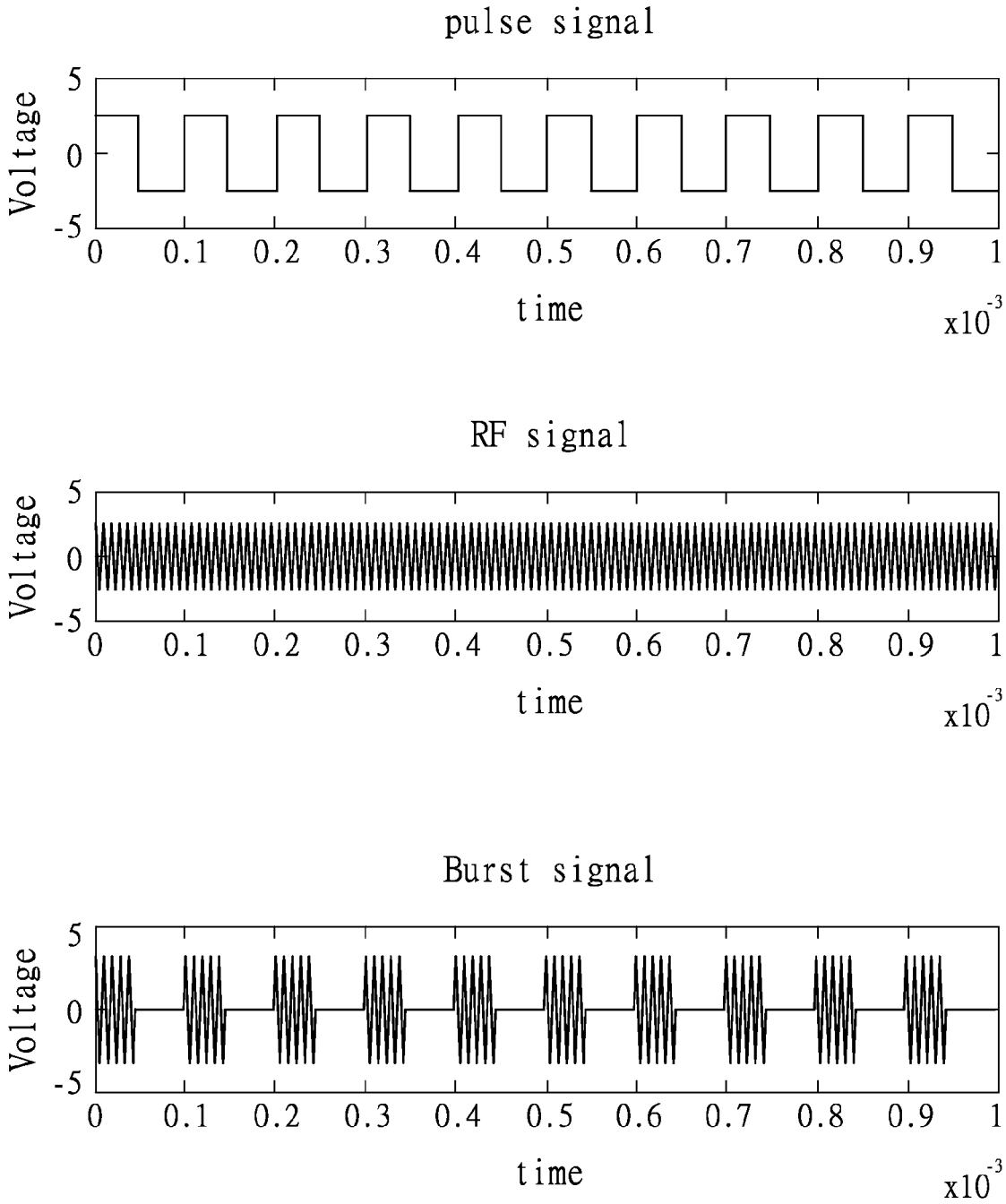
FIG. 3 shows the charts of driving signals of a highly-efficient ultrasonic ink-jet head in accordance with the present invention.

Referring to FIG. 3 for a schematic diagram of driving signals of a highly-efficient ultrasonic ink-jet head in accordance with the present invention, the invention uses a radio frequency (RF) signal with a natural frequency of the piezoelectric transducer to drive and produce ultrasonic waves, and modulates the radio frequency signal with a square-wave signal to produce a burst signal, and act each burst signal including a plurality of radio frequency signals enough time to accumulate sufficient ultrasonic power, and incorporates the plane lens providing the focusing and ink-jet effects to overcome the surface tension near the ink surface.

Figure 4:
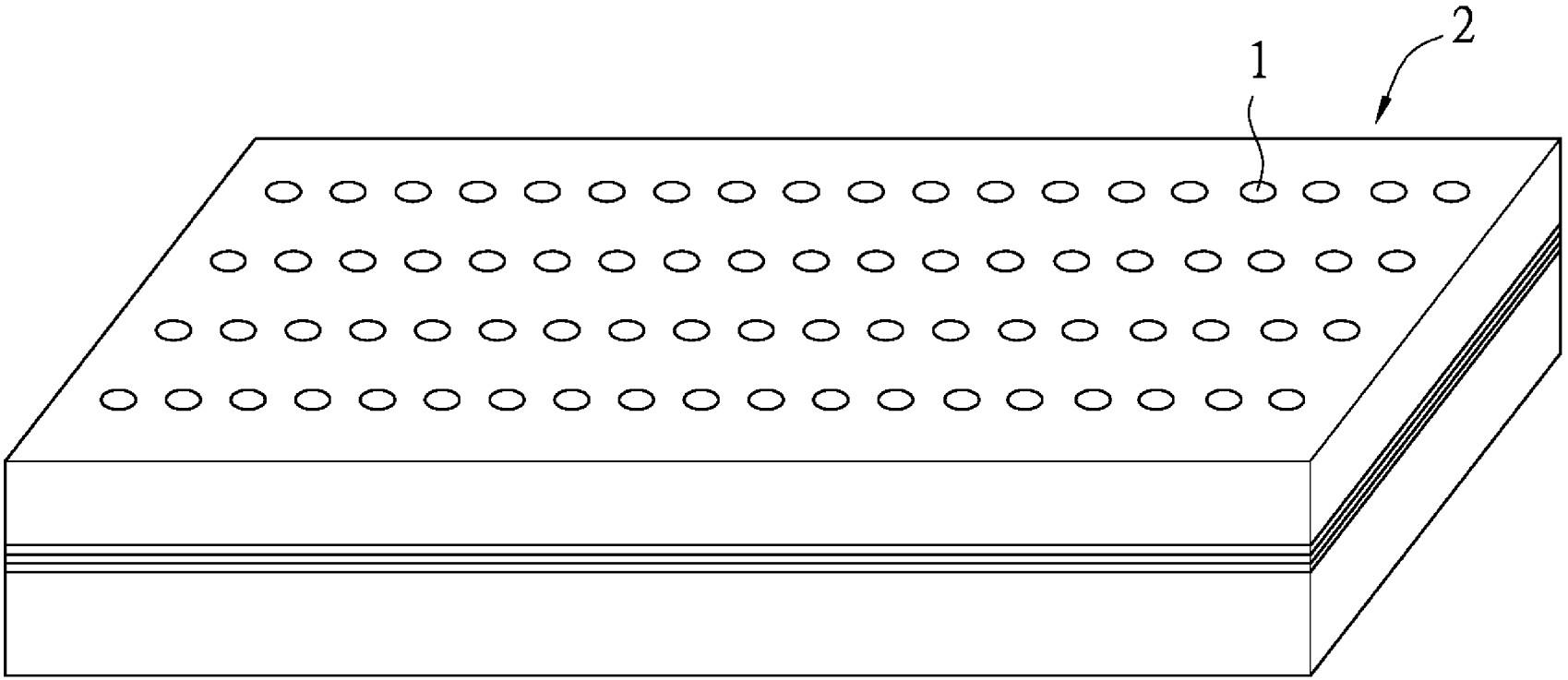
FIG. 4 is a schematic view of an arrangement of an array ink-jet head in accordance with the present invention.

The structure of the highly-efficient ultrasonic ink-jet head 1 in accordance with the present invention achieves the effects of providing a total reflection of the ultrasonic waves through the deviation of acoustic impedance of the ultrasonic waves. This reduces the power consumption during transmission and improves the efficiency of using planar sound waves generated by the piezoelectric transducer. The size of ink droplets and focusing lens relates to the driving frequency of the ultrasonic wave, and thus a high-frequency piezoelectric transducer decreases the diameter of the ink-jet head and the area of the piezoelectric transducer, and thus results in the concern of insufficient ink-jet energy. The structure of a highly-efficient ultrasonic ink-jet head 1 in accordance with the present invention can utilize the sound wave energy more effectively in a piezoelectric transducer of a small area. If the area of the focusing lens becomes smaller, the number of ink-jet heads arranged per unit area will increase. With the arrangement of an array ink-jet head 2 (as shown in FIG. 4), the distance between ink dots can be shortened to improve the ink jet precision and comply with the requirements of the color filter manufacturing process, and thus the coating manufacturing technology applied for a color filter of a large area is developed after the piezoelectric ink jet and thermal bubble jet technologies. When the piezoelectric transducer generates mechanical energy of the ultrasonic wave, the sound wave energy can be used more effectively in a limited area to eject ink droplets, and the high-precision spray can meet the color filter manufacturing requirements, and thus the invention can be applied in the related areas of color filter manufacturing process and graphic/text printers.

Figure 5:
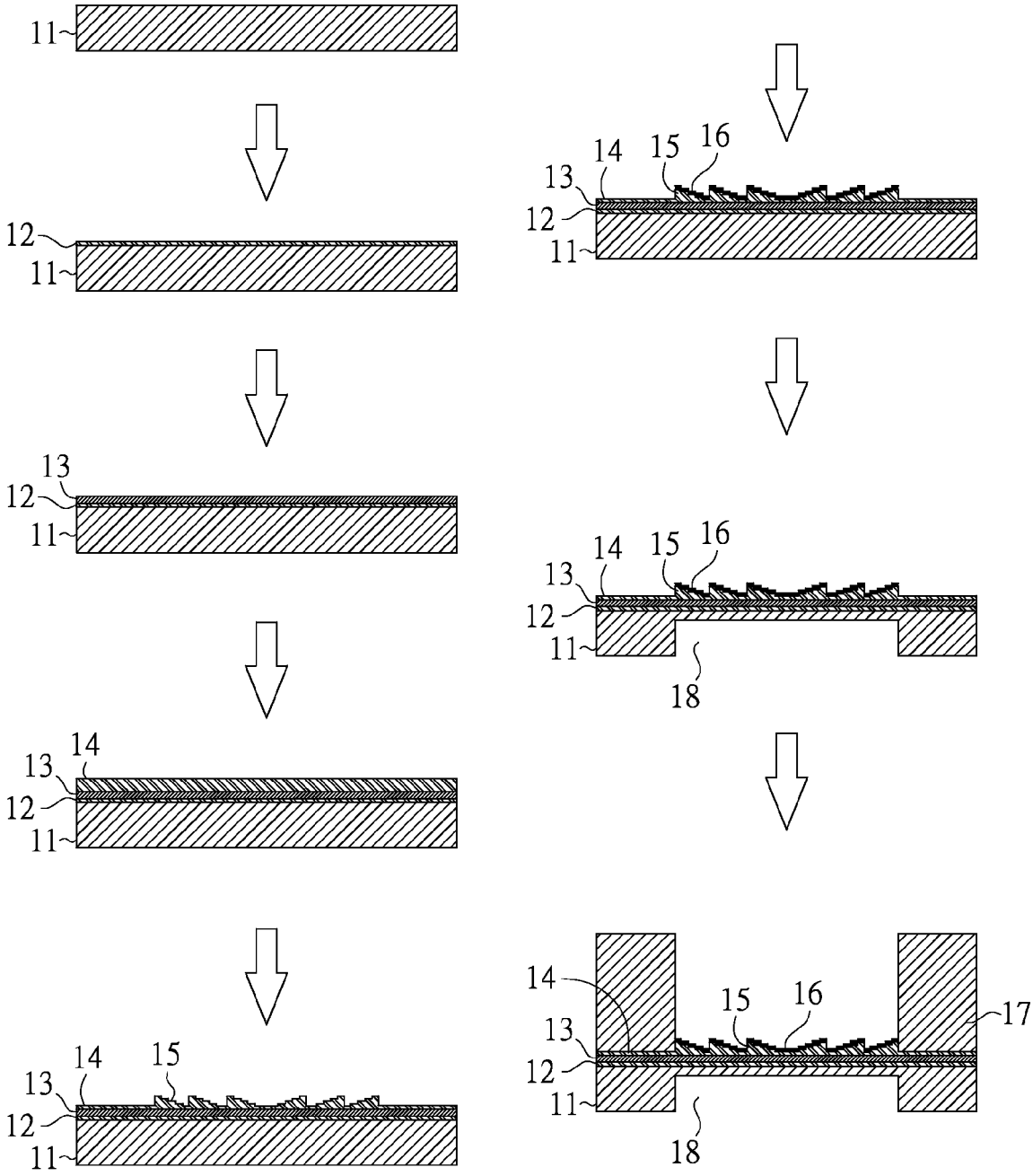
FIG. 5 is a process flow of fabricating a highly-efficient ultrasonic ink-jet head in accordance with the present invention.

Referring to FIG. 5 for a schematic view of a manufacturing a highly-efficient ultrasonic ink-jet head in accordance with the present invention, a glass/silicon substrate 11 is used as a supporting layer, and the supporting layer is a glass/silicon substrate 11 (such as quartz glass), made of ceramic or any material matching the acoustic impedance, and the glass/silicon substrate 11 is made of a material chemically inactive with the ink, and a lower electrode layer 12 made of a metal film is spluttered or deposited on the supporting layer, and the lattice is a piezoelectric layer 13 of (002), and an upper electrode layer 14 is made of a metal film with a sufficient thickness, and the metal film is made of titanium (Ti), copper (Cu) or a metal electrode material that matches the acoustic impedance. The piezoelectric layer is made of zinc oxide (ZnO), lead-titanium zirconate (PZT) or a material having the piezoelectric effect for generating ultrasonic waves. A photolithographic method is used to etch a plane lens (which is a four-level Fresnel lens 150) on the upper electrode layer 14 made of a metal film, and deposits an impedance matching layer 16 on the plane lens, and forms a reflection chamber 18 on another side of the glass/silicon substrate 11 by the photolithography and etching method, and the glass/silicon substrate 11 is a structure of a reflection chamber 18 having an area greater than the plane lens, and finally the glass/silicon substrate 11 with a surface of the plane lens is bonded with an ink storing groove 17 made by a laser manufacturing process. The area of a side of the ink storing groove 17 is larger than the area of the plane lens, and the area of another side of the ink storing groove 17 is larger than a circular hole for passing an ink droplet, so that if the ultrasonic wave is transmitted from a glass/silicon substrate 11 with an acoustic impedance Z of 20~27 MRayl to the air (Z=0.00004 MRayl), the difference of acoustic impedances will be very large, and thus causing a reflection of ultrasonic power, and improving the energy efficiency of the highly-efficient ultrasonic ink-jet head 1. As to the selection of materials, acoustic impedance matching must be taken into consideration. If the acoustic impedance of ink is $Z_{ink}$, and the acoustic impedance of the glass/silicon substrate 1 is $Z_{glass}$, and the acoustic impedance of the piezoelectric transducer is $Z_{transducer}$, and the acoustic impedance of the acoustic impedance matching layer 16 is $Z_m$, the material selected for making the lens must have an acoustic impedance of $Z_{lens}=\{\text{fourth root}\}\sqrt{Z_m{}^3 Z_{transducer}}$, and the material selected for making the glass/silicon substrate 11 or the piezoelectric transducer must have an impedance match of $Z_{glass}=\{\text{fourth root}\}\sqrt{Z_m Z_{transducer}{}^3}$. The material selected for making the acoustic impedance matching layer 16 must have an impedance match of $Z_{glass}=\{\text{fourth root}\}\sqrt{Z_{ink} Z_{transducer}{}^3}$.

In summation of the description above, the highly-efficient ultrasonic ink-jet head 1 and the fabrication method for the same in accordance with the present invention can effectively overcome the shortcomings of the conventional ultrasonic ink-jet heads, so that the ultrasonic energy can be used efficiently to produce high-precision spraying effect. The present invention herein enhances the performance than the conventional structure and further complies with the patent application requirements and is duly submitted for patent application.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A highly-efficient ultrasonic ink-jet head, comprising:

a supporting layer;

a piezoelectric transducer, installed on the supporting layer, and sequentially including a lower electrode layer, a piezoelectric layer and an upper electrode layer;

a focusing lens, being a plane lens structure, and installed on the upper electrode layer;

an acoustic impedance matching layer, disposed on the focusing lens; and an ink storing groove, bonded with the acoustic impedance matching layer.

2. The highly-efficient ultrasonic ink-jet head as recited in claim 1, wherein the focusing lens is a $2^n$-level Fresnel lens structure and n is a positive integer.

3. The highly-efficient ultrasonic ink-jet head as recited in claim 1, wherein the supporting layer is designed and etched, such that the reflected ultrasonic wave energy has the same phase with the direct ultrasonic wave.

4. The highly-efficient ultrasonic ink-jet head as recited in claim 1, wherein the ink storing groove has a side with an area greater than the area of the focusing lens, and the other side with an area greater than a circular hole for passing an ink drop.

5. A fabrication method for a highly-efficient ultrasonic ink-jet head, comprising the steps of:

(a) obtaining a substrate that is used as a supporting layer, and using a deposition method or a spluttering method to sequentially plate a lower electrode layer, a piezoelectric layer and an upper electrode layer of the piezoelectric transducer on a surface of the substrate;

(b) etching a focusing lens at the upper electrode layer by a photolithographic method;

(c) depositing an impedance matching layer on the focusing lens; and (d) etching the reflection chamber on another surface of the substrate by using the photolithographic method.

6. The fabrication method for a highly-efficient ultrasonic ink-jet head as recited in claim 5, wherein the supporting layer is made of a material selected from the collection of a glass/silicon substrate, ceramic or a material matching the acoustic impedance.

7. The fabrication method for a highly-efficient ultrasonic ink-jet head as recited in claim 5, wherein the lower electrode layer and the upper electrode layer are made of a metal film, and the metal film is made of a material selected from the collection of titanium (Ti), copper (Cu) and a metal electrode material matching the acoustic impedance.

8. The fabrication method for a highly-efficient ultrasonic ink-jet head as recited in claim 5, wherein the piezoelectric layer is made of a piezoelectric material selected from the collection of zinc oxide (ZnO), lead-titanium zirconate (PZT) and a material having the piezoelectric effect for generating ultrasonic waves.

9. The fabrication method for a highly-efficient ultrasonic ink-jet head as recited in claim 5, wherein the substrate is a reflection chamber structure having a bottom area greater than the area of the focusing lens.

10. The fabrication method for a highly-efficient ultrasonic ink-jet head as recited in claim 5, wherein the substrate is made of a material chemically inactive with ink.

* * * * *